US005201286A

United States Patent [19]

Kerrigan

[11] Patent Number: 5,201,286

[45] Date of Patent: Apr. 13, 1993

[54] TWO-STROKE CYCLE INTERNAL COMBUSTION ENGINE

[75] Inventor: Eugene E. Kerrigan, Columbus, Ohio

[73] Assignee: Malibu Corporation, Columbus, Ohio

[21] Appl. No.: 853,113

[22] Filed: Mar. 18, 1992

Related U.S. Application Data

[63] Continuation-in-part of Ser. No. 703,508, May 21, 1991, abandoned.

[51] Int. Cl.[5] ..... F01L 11/00

[52] U.S. Cl. ..... 123/47 A; 123/74 AE

[58] Field of Search ..... 123/47 R, 47 A, 74 AE, 123/65 R

[56] References Cited

U.S. PATENT DOCUMENTS

| | | | |
|---|---|---|---|
| 1,010,754 | 12/1911 | Hall . | |
| 1,580,720 | 4/1926 | Gold . | |
| 1,744,157 | 1/1930 | Browne . | |
| 2,194,863 | 3/1940 | Merry | 123/47 A |
| 2,274,644 | 3/1942 | Arden | 123/47 A |
| 2,319,427 | 5/1943 | Morgan | 123/47 |
| 2,393,542 | 1/1946 | Kramer | 123/47 |
| 2,431,859 | 12/1947 | Fisher | 123/73 |
| 2,781,031 | 2/1957 | Barberi | 123/47 |
| 3,301,234 | 1/1967 | Reilly | 123/47 |
| 3,340,851 | 9/1967 | Foster | 123/32 |
| 4,112,882 | 9/1978 | Tews | 123/47 A |
| 4,958,601 | 9/1990 | Lyons | 123/47 R |

FOREIGN PATENT DOCUMENTS

| | | | |
|---|---|---|---|
| 0118697 | 7/1944 | Australia | 123/47 A |
| 0394219 | 9/1908 | France | 123/47 A |
| 0837185 | 2/1939 | France . | |
| 57-105501 | 7/1982 | Japan | 123/47 AA |

*Primary Examiner*—David A. Okonsky

*Attorney, Agent, or Firm*—Pearne, Gordon, McCoy & Granger

[57] ABSTRACT

A two-stroke cycle internal combustion engine including a crankshaft, a connecting rod pivotally connected to the crankshaft, a fuel induction system and spark plug or the like. The cylinder has a closed head end and a closed rearward end and a piston within the cylinder defines a combustion chamber as well as a charging chamber. A plurality of radial inlet ports formed in the cylinder wall is normally closed by the piston but is opened to the charging chamber when the piston passes through its top dead center position. A plurality of radial exhaust ports also is formed in the cylinder wall and is normally closed by the piston but opened to the combustion chamber as the piston passes through its bottom dead center position. An axial valve port is formed in the crown of the piston to communicate between the charging chamber and the combustion chamber. An operating rod mounted in the cylinder has a valve head formed on its inner end to close the valve port. The other end of the operating rod extends through a sealed axial passage at the bottom of the cylinder end is connected to the connecting rod. When the piston approaches its bottom dead center position, its retraction movement is limited by fluid pressure caused by compressed gas in the charging chamber and accordingly the operating rod disengages from the crown of the piston to open the valve port and admit a charge from the charging chamber to the combustion chamber.

27 Claims, 6 Drawing Sheets

TWO-STROKE CYCLE INTERNAL COMBUSTION ENGINE

This application is a continuation-in-part of U.S. patent application Ser. No. 07/703,508, filed May 21, 1991 and now abandoned.

BACKGROUND OF THE INVENTION

This invention relates to two-stroke cycle internal combustion engines wherein a complete operating cycle is accomplished during a single rotation of the engine crankshaft. In other words; the phases of compression, ignition, expansion, exhaust, and induction are all accomplished during the extension and retraction strokes of the piston. More particularly the invention relates to a unique two-stroke engine design that minimizes valving and eliminates the need to provide lubricating oil with the fuel supplied for combustion. At the same time the engine of the invention has a low level of discharged gaseous pollutants.

Two-stroke cycle internal combustion engines have traditionally had certain advantages over four-stroke cycle engines for many applications. The advantages have included a greater output per unit of weight because a power stroke occurs during each crankshaft revolution. On the other hand, prior art two-stroke cycle engines suffer from a requirement that lubricating oil be mixed with the fuel. The result is that some lubricating oil is burned and undesirable gaseous pollutants and smoke are produced. Also in prior art designs the exhausting of gaseous combustion products is often incomplete.

In typical prior art designs a fuel/air mixture is introduced through the crankcase and ported to the combustion chamber through an inlet valve. This requires that the lubricating oil be mixed with the fuel or otherwise injected into the fuel/air mixture.

Prior art two-stroke engines also usually require extensive valving to control fuel/air induction and discharge of exhaust gases. Typically the induction of the fuel/air mixture must overlap the discharge of exhaust gases through an exhaust port and this may result in either incomplete exhausting of combustion products or a more complete exhausting combined with the further exhausting of a portion of the unburned fuel/air mixture being introduced into the combustion chamber. These factors result in a high level of gaseous pollutants and reduced fuel efficiency.

Another problem encountered in prior art engines is sometimes referred to as piston scuffing. This occurs in some engines where the piston itself is connected directly to a connecting rod by a wrist pin. As a result, certain forces acting on the piston produce side loads between the piston skirt and cylinder wall. These side loads can produce scuffing as the piston traverses the cylinder wall exhaust and bypass ports.

While some more recent techniques have improved exhaust scavenging through the use of the fuel/air charge, this also results in the loss of fuel and thus lower fuel efficiency.

The device of the present invention, however, reduces the difficulties described above and provides other features and advantages heretofore not obtainable.

SUMMARY OF THE INVENTION

A general object of the invention is to improve the overall efficiency of two-stroke cycle internal combustion engines, to simplify the mechanical design and to minimize the assembly time required.

It is among the more specific objects of the invention to provide a two-stroke cycle internal combustion engine that minimizes the discharge of smoke and other gaseous pollutants.

Another object is to eliminate the need to add lubricating oil to the fuel used for two-stroke engines.

A further object is to eliminate the use of crankcase induction as in prior art two-stroke internal combustion engines.

Still another object is to provide improved exhaust gas scavenging in two-stroke internal combustion engines.

These and other objects and advantages are achieved through the unique two-stroke internal combustion engine of the present invention wherein the improvement resides in a design that generally includes a crankshaft, at least one connecting rod pivotally connected to the crankshaft, fuel induction means and ignition means. The improvement resides in a cylinder having a closed head end, a closed rearward end and a reciprocating piston in the cylinder that defines therewith a combustion chamber and a charging chamber as the piston moves between its top dead center and bottom dead center positions. A plurality of radial inlet ports is formed in the cylinder wall so as to be normally closed by the piston but which are open to the charging chamber when the piston passes through its top dead center position. A plurality of radial exhaust ports are also formed in the cylinder wall so as to be normally closed by the piston but which are open to the combustion chamber when the piston passes through its bottom dead center position.

Means are formed in the crown of the piston to define an axial port communicating between the charging chamber and the combustion chamber and forming a rearwardly facing valve seat. An operating rod is axially mounted in the cylinder. It extends through a sealed axial passage in the closed rearward end of the cylinder. The operating rod is pivotally connected at its outer end to the connecting rod and has a valve head formed on its inner end to sealingly engage the valve seat to close the valve port.

The piston and operating rod are in valve closing engagement during the operating cycles of the engine except for a portion of each operating cycle when the piston passes through its bottom dead center position. In that portion of the cycle the retraction movement of the piston is limited by fluid pressure caused by compressed air in the charging chamber. Nevertheless, the operating rod is further retracted by the crankshaft, and the operating rod thus opens the valve port to admit a charge of air from the charging chamber to the combustion chamber.

The operating rod is provided with a piston retractor that cooperates with means formed in the interior of the piston when necessary. This is generally only required during starting and after misfire.

The cylinder is preferably formed of grey iron with a type A pearlite and graphite matrix in order to provide inherent lubricity. Also, the piston is preferably formed of thin-walled steel to harmonize with the coefficient of thermal expansion of the cylinder.

DESCRIPTION OF THE PREFERRED EMBODIMENT

Figure 1:
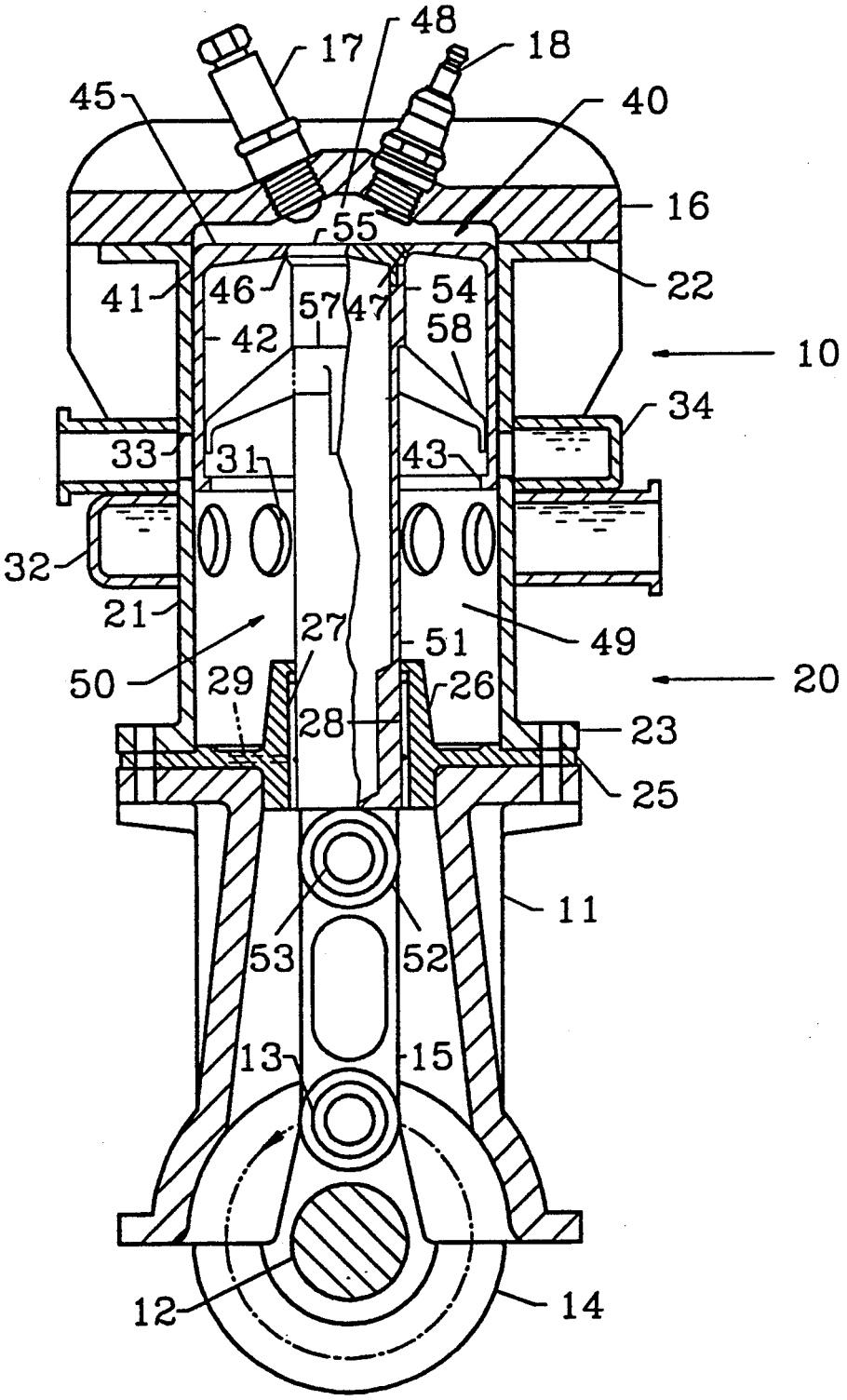
FIG. 1 is a sectional view showing a two-stroke cycle internal combustion engine embodying the present invention with the piston shown in its top dead center position and with parts broken away for the purpose of illustration.

Referring more particularly to the drawings there is shown a two-stroke internal combustion engine 10 embodying the present invention and including as general components an engine block 11, a crankshaft 12, a crank pin 13, a counterweight 14 and a connecting rod 15 connected at one end to the crank pin 13. A cylinder assembly 20 and piston assembly 40 are mounted on the engine block and a cylinder head 16 is, in turn, mounted on the upper end of the cylinder assembly 20. A fuel injector 17 is mounted in the cylinder head 16 in communication with the interior of the cylinder, along with a spark plug 18.

The cylinder assembly 20 includes a generally thin-walled cylinder 21 preferably formed of a material that provides a high lubricity at operating temperatures. For example, the cylinder may be formed of grey iron with a type A pearlite and graphite matrix. The cylinder 21 has a radial flange 22 at its upper end that engages the mounting surfaces of the cylinder head 16 and another radial flange 23 at its lower end for mounting the cylinder assembly 20 to the engine block 11.

The cylinder assembly 20 includes a bottom end plate 25 that serves to close the bottom end of the cylinder and which has a circumferential portion that fits between the radial flange 23 and the mounting surface of the engine block 11. The end plate 25 has a central hub 26 that defines a sealed axial bore 27 for a component of the piston assembly to be described below. A bronze bushing 28 is mounted in the hub. Lubricating oil is supplied to the contacting surfaces through an oil gallery 29.

A plurality of radial air inlet ports 31 is formed in the cylinder 21 near the lower end thereof. The inlet ports 31 communicate with an air inlet manifold 32.

A plurality of radial exhaust ports 33 is also formed in the wall of the cylinder 21 at a location spaced above the inlet ports 31. The exhaust ports 33 communicate with an annular exhaust manifold 34.

The piston assembly 40 includes a piston 41 preferably formed of steel and having a relatively thin cylindrical wall 42. A small radial flange 43 is formed at the lower end of the cylindrical wall 42 and extends slightly inwardly as shown.

The piston assembly 40 also has an integral annular crown 45 that defines an axial valve port 46. A frusto-conical valve seat 47 is formed around the valve port with the surfaces flaring outwardly in a downward direction toward the interior of the piston.

The cylinder assembly 20 and piston assembly 40 define a combustion chamber 48 above the crown 45 of the piston and a charging chamber 49 located partly within the interior of the cylindrical piston and also within the lower portion of the cylinder assembly 20.

Figure 3:
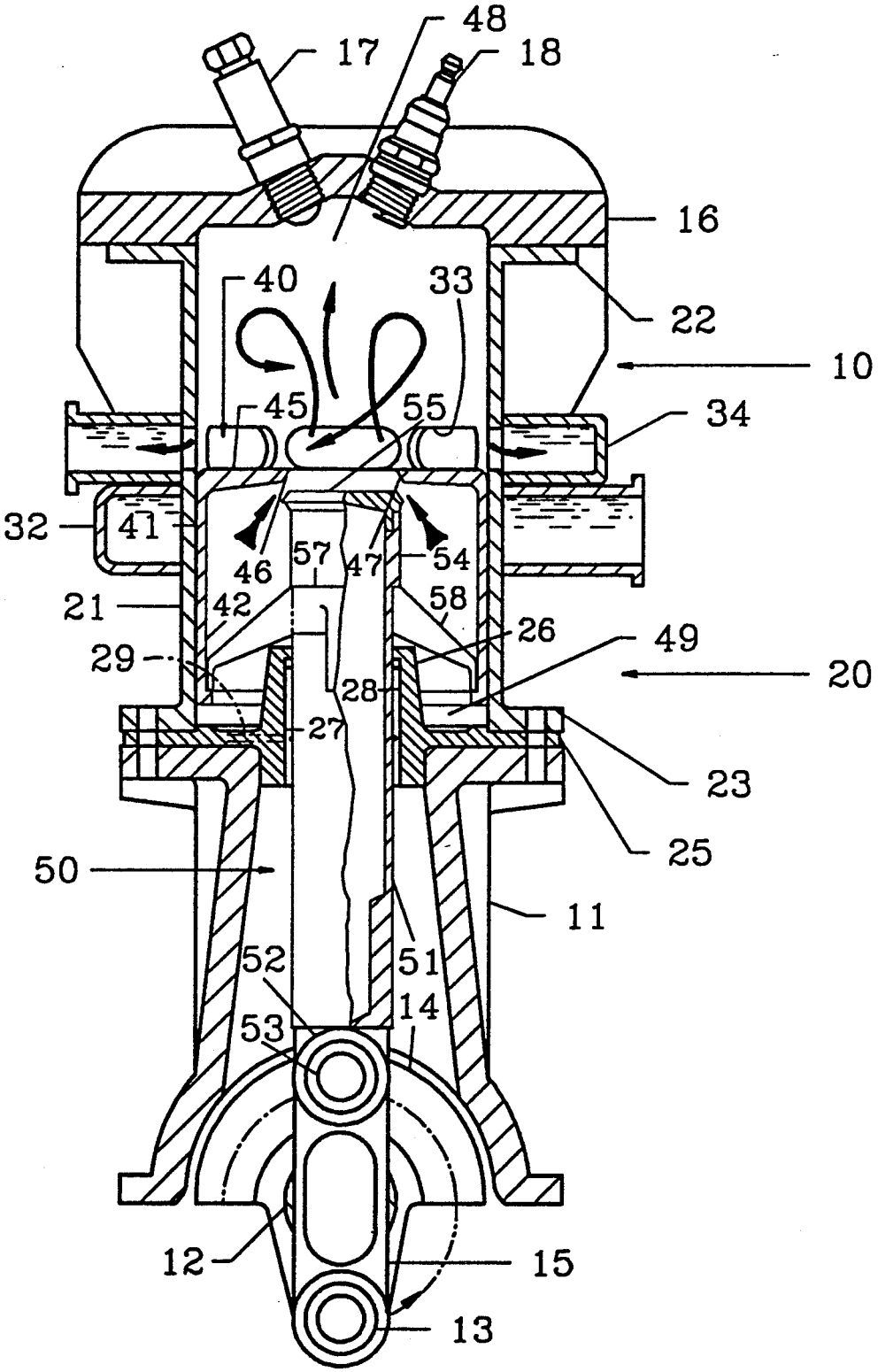
FIG. 3 is a sectional view similar to FIGS. 1 and 2 showing the piston in its bottom dead center position.

When the piston is in its top dead center position as shown in FIG. 1, the radial air inlet ports 31 are open to communicate with the charging chamber 49. The pressure in the charging chamber is reduced to a vacuum at that instant because of the expansion of the charging chamber as the piston moves toward its top dead center position. When the piston is in its bottom dead center position as shown in FIG. 3 the radial exhaust ports 33 are open and permit the exhausting of gaseous products of combustion through the ports 33 into the exhaust manifold 34. Throughout the other positions of the piston cycle both the radial inlet ports 31 and the radial exhaust ports are effectively closed by the piston itself without any need for additional valving.

In accordance with the invention the piston assembly 40 further includes a steel operating rod assembly 50 which generally comprises a cylindrical steel tube 51 that extends through the sealed axial bore 27 defined by the hub 26 and bronze bushing 28. The lower end of the rod assembly 50 has a connecting socket 52 to permit its connection to the upper end of the connecting rod 15 by means of a pivot pin 53.

A radially enlarged shoulder portion 54 is formed on the upper end of the cylindrical tube 51 and has a valve head 55 mounted thereon. The valve head is provided with frusto-conical surfaces that engage the valve seat 47 formed in the crown 45 of the piston 41.

Accordingly, it will be apparent that the piston 41 is not secured to the operating rod assembly 50 but on the contrary, floats in the cylinder and is forced into valve closing engagement with the valve head 55 of the rod assembly 50 only in response to operating pressures that occur during the engine cycle.

Figure 4:
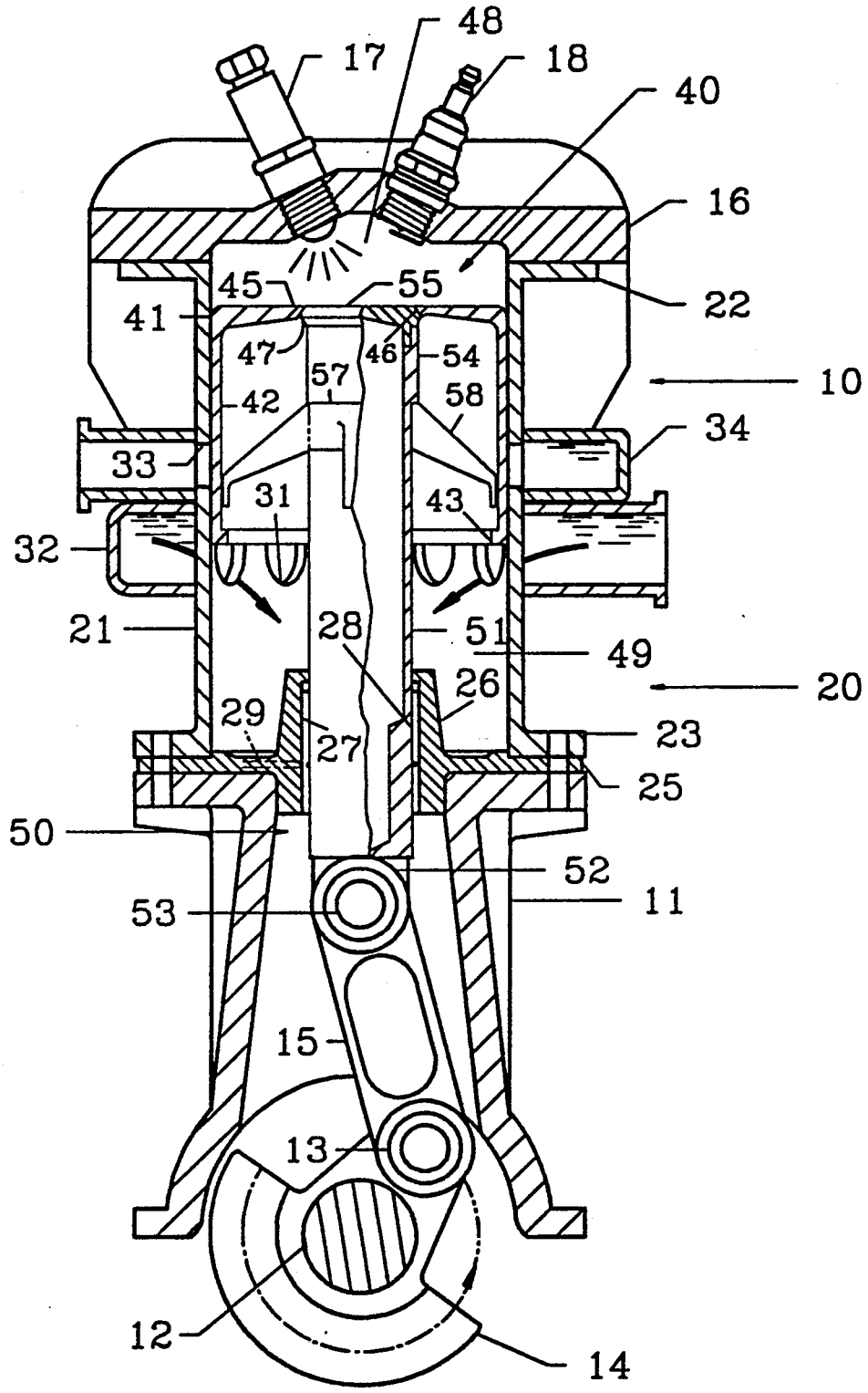
FIG. 4 is a sectional view showing the piston in the mid-compression stroke.

These pressures dictate that the piston and rod assembly are engaged during the compression stroke (FIGS. 1 and 4), and the expansion stroke (FIG. 2) up to the point where the pressure in the combustion chamber during the exhaust phase is balanced by the fluid pressure caused by the compression of charging air in the charging chamber 49. That condition is illustrated in FIG. 3 where it will be seen that the piston reaches a neutral position (resulting from pressure balance) at a point that occurs before the bottom dead center position of the operating rod assembly 50 and connecting rod 15 (FIG. 3).

Because the piston floats to a neutral position at that point and because the valve head 55 is opened by the further retraction movement the compressed air charge in the charging chamber 49 is released into the combustion chamber. This sudden release of air under pressure facilitates the scavenging of exhaust gases through the radial exhaust ports 33 into the exhaust manifold 34. Since fuel has not yet been injected into the air charge, at this point, no unburned fuel is mixed with the exhaust gases leaving the combustion chamber.

Because of the high velocity of air entering the combustion chamber due to the high pressure in the charging chamber an optimum scavenging of exhaust gas is achieved by the time the exhaust port are closed by the upward or extension movement of the piston assembly 40.

Located within the interior of the piston 41 and slidably received on the operating rod assembly 50 is a piston retractor 57 with four radial retractor arms 58 that extend from the rod assembly outwardly to the interior surface of the cylindrical piston wall 42. The retractor arms do not function during the normal operating cycle, however, they are effective for example, during starting and after misfire, to engage the upper portion of the radial flange 43 so that when the engine is cranked the rod assembly will engage and move the piston when the connecting rod pulls the rod assembly downward in response to rotation of the crankshaft. That specific condition of engagement is shown only in FIG. 3 of the drawings.

Since the piston is freely mounted in the cylinder, it may rotate relative to the cylinder during operation. This freedom permits the piston to index around the cylinder to reach an optimum seating condition and maintain concentricity.

OPERATION

Figure 5:
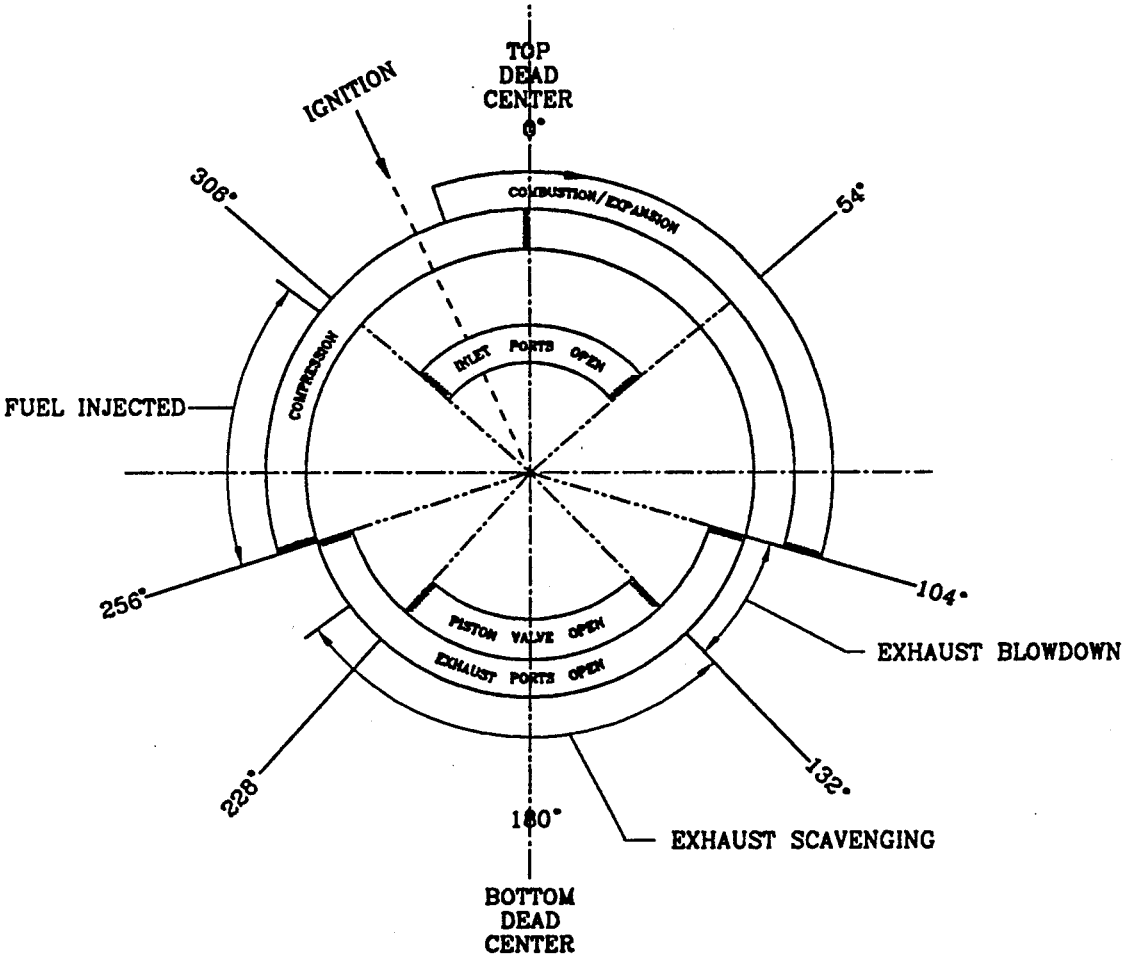
FIG. 5 is a sequencing diagram illustrating an operating cycle for the two-stroke cycle internal combustion engine of FIGS. 1-4.

The operation of the two-stroke engine 10 will be described with respect to one complete rotation of the crankshaft as illustrated diagrammatically in FIG. 5, or in other words, one extension/retraction of the piston, beginning with the position shown (top dead center) in FIG. 1. Before the top dead center position (i.e. at the 256° position as shown in FIG. 5) the fuel injector 17 injects a charge of fuel into the combustion chamber 48.

Then, at the 306° position, the radial air inlet ports 31 are open to admit air from the inlet manifold 32 into the charging chamber 49 of the cylinder. At the instant the inlet ports are opened, the gas pressure in the charge chamber is reduced because of the expansion of the charge chamber.

Figure 2:
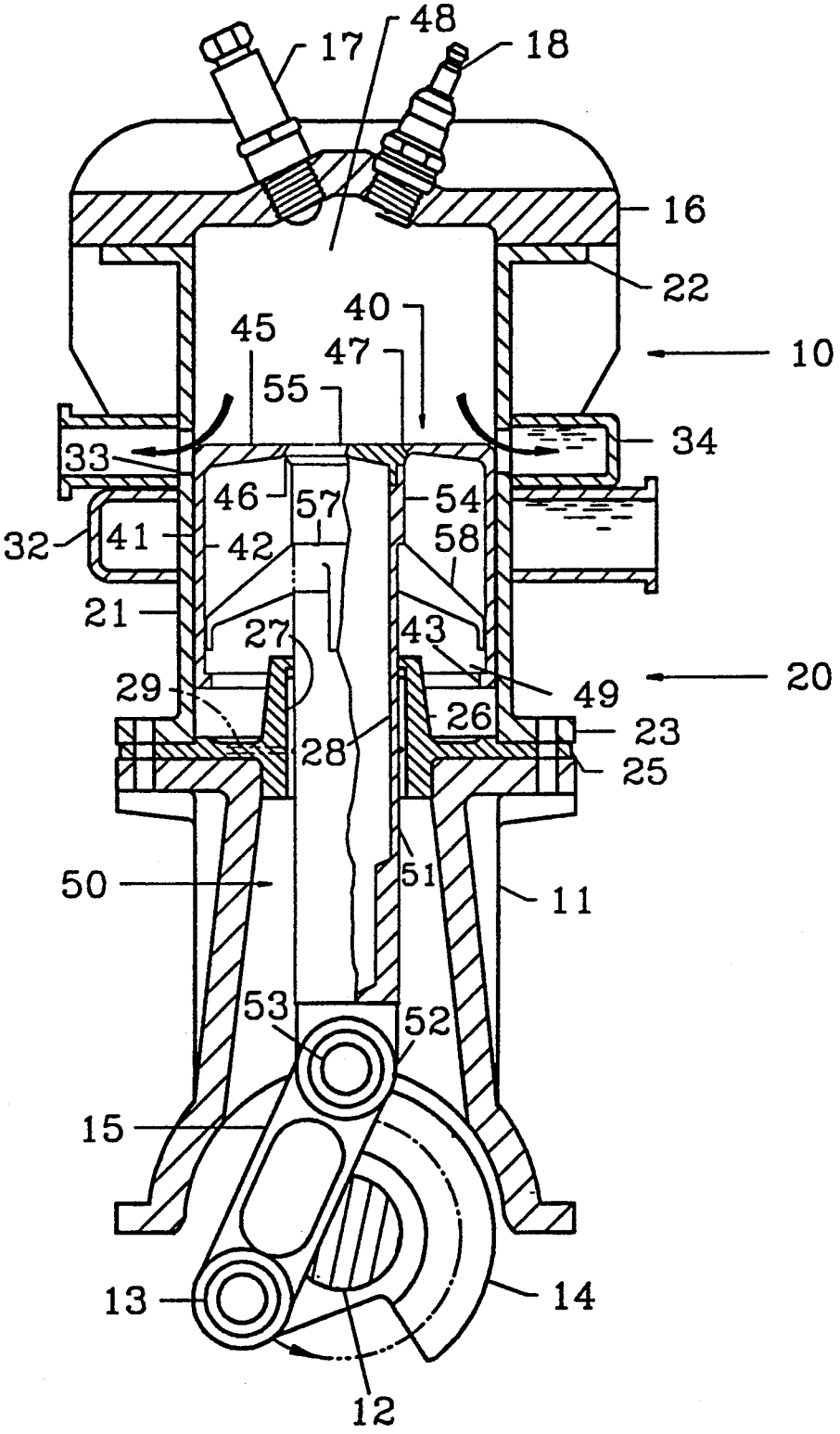
FIG. 2 is a sectional view of the two-stroke cycle engine of FIG. 1 showing the piston at the final portion of the power stroke.

As the piston approaches the top dead center position and completes compression of the fuel/air mixture the spark plug 18 is energized to ignite the fuel/air mixture. This initiates the expansion of the combustion chamber so that the piston begins its retraction movement as illustrated in FIG. 2. As the retraction movement proceeds, the radial air inlet ports 31 are closed by the piston (i.e. at the 54° position) and further retraction compresses the induction air in the charging chamber 49.

As combustion is completed, the piston 41 retracts sufficiently (i.e. at 104°) to open the radial exhaust ports 33 following expansion of the combustion chamber and to permit the gaseous combustion products to be discharged into the exhaust manifold 34. This reduces the pressure in the combustion chamber until it approximately equals the pressure of the compressed air charge in the charging chamber 49. As this occurs, the floating piston 41 reaches a neutral or pressure balanced position and stops its downward or retraction movement at about the 132° position.

Nevertheless, in accordance with the design of the invention, the retraction movement of the operating rod assembly continues until the rod assembly 50 and connecting rod 15 approach the bottom dead center position. This further retraction opens the valve port 46 and the compressed air charge is released into the combustion chamber wherein it assists in the expulsion of exhaust gases from the combustion chamber.

As rotation of the crankshaft 12 continues, the operating rod assembly 50 is moved upward until the valve head 55 engages the valve seat 47 and closes the valve port 46 at about the 228° position. Further, upward movement closes the exhaust ports 33 thus completing the cycle and preparing the new air charge for compression and the injection of fuel.

FIG. 6

Figure 6:
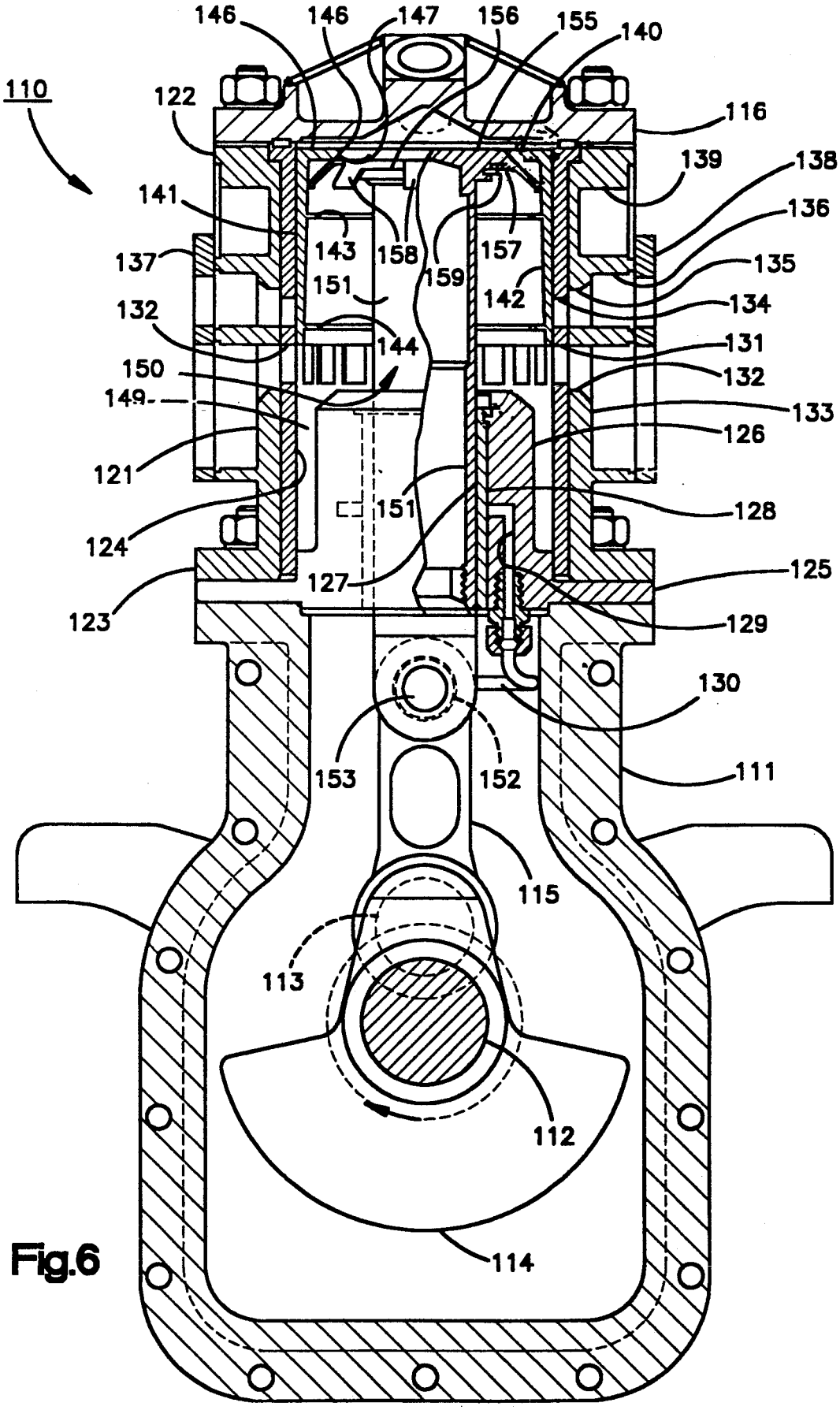
FIG. 6 is a sectional view showing an alternate form of a two-stroke cycle internal combustion engine embodying the invention with parts broken away for the purpose of illustration.

FIG. 6 shows an alternate form of two-stroke cycle internal combustion engine embodying the invention. While basically similar to the embodiment of FIGS. 1 through 5, the alternate form provides for a greater compression ratio for the charging chamber. This embodiment also has a modified cylinder construction.

Referring to FIG. 6, the engine (identified by the numeral 110) has as general components, an engine block 111, a crankshaft 112, a crank pin 113, a counterweight 114 and a connecting rod 115 connected at one end to the crank pin 113. A cylinder assembly 120 and piston assembly 140 are mounted on the engine block 111 and a cylinder head 116 is mounted on the upper end of the cylinder assembly 120.

The cylinder assembly 120 includes a cylinder barrel 121, preferably formed of an aluminum alloy. The barrel has a radial flange 122 at its upper end that engages the mounting surfaces of the cylinder head 116 and another radial flange 123 at its lower end for mounting the cylinder assembly 120 to the engine block 111.

Tightly fitted within the bore of the cylinder barrel 121 is a cylinder liner 124. The liner is preferably formed of a material that provides a high lubricity at operating temperatures. For example, it may be formed of grey iron with a type A pearlite and graphite matrix.

The cylinder assembly 120 also includes a bottom end plate 125 that serves to close the bottom end of the cylinder and which has a circumferential portion that fits between the radial flange 123 and the mounting surface of the engine block 111. The end plate 125 has a relatively large central hub 126 that functions in a manner similar to the hub 26 of FIGS. 1 through 5 but which is considerably larger so as to provide for a greater compression ratio in the charging chamber. A bronze bushing 128 is mounted on the hub 126 and lubricating oil is supplied to the contacting surfaces of the bushing 128 through an oil gallery 129. Oil is supplied to the oil gallery 129 by a length of tubing 130 that terminates at a fitting which is threaded into the hub 126 from below.

A plurality of radial air inlet ports 131 are formed in the cylinder liner 124 as indicated in FIG. 6. The inlet ports communicate through corresponding radial ports 132 in the barrel, with an annular air inlet manifold that is formed in part by an annular groove 133 formed in the cylinder barrel. An annular band (not shown) encloses the groove. A plurality of radial exhaust ports 134 are formed in the cylinder liner 124 at a location spaced above the inlet ports 131. The exhaust ports 134 communicate through corresponding ports 135 also formed in the barrel, with an annular exhaust manifold that is formed in part by another annular groove 136 formed in the cylinder barrel. Manifold plates 137 and 138 with suitable ports provide access to the respective annular manifolds.

The cylinder barrel also has an annular groove 139 closed by an annular band to provide a passage for liquid coolant.

The piston assembly 140 includes a piston 141, preferably formed of steel, and having a relatively thin, cylindrical wall 142. A small radial rib 143 is formed at the upper end of the cylindrical wall 142 and extends slightly inwardly, as shown. Another small radial rib 144 is formed at the lower end of the cylindrical wall 142 and also extends slightly inwardly.

The piston assembly 140 also has an integral annular crown 145 that defines an axial valve port 146. A frusto-conical valve seat 147 is formed around the valve port with the surfaces flaring outwardly in a downward direction toward the interior of the piston.

The cylinder assembly 120 and piston assembly 140 define a combustion chamber 148 above the crown 145 of the piston and a charging chamber 149 located partly within the interior of the cylindrical piston and also within the lower portion of the cylinder assembly 120.

When the piston is in its top dead-center position as shown in FIG. 6, the radial air inlet ports 131 are open to communicate with the charging chamber 149. When the piston approaches its bottom dead-center position (not shown) the radial exhaust ports 133 are open and permit the exhausting of the gaseous products of combustion through the ports 133 into the exhaust manifold 134.

It will be noted that the piston may also be formed of other suitable materials for special applications. For example, in some highly specialized applications, it may be desirable to form the piston of titanium.

The piston assembly 140 further includes a steel operating rod assembly 150 which generally comprises a cylindrical steel tube 151 that extends through the sealed axial bore 127 defined by the hub 126 and bronze bushing 128. The lower end of the rod assembly 150 has a connecting socket 152 to permit its connection to the upper end of the connecting rod 115 by means of a pin 153.

The cylindrical tube 151 has a valve head 155 mounted thereon. The valve head is provided with frusto-conical surfaces that engage the valve seat 147 formed in the crown 145 of the piston 141. The resulting valve means function in the same manner described with respect to the embodiment of FIGS. 1 through 5.

The valve head 155 is provided with an annular shoulder 156 that provides a seat for a generally annular fetch pawl 157 which functions in somewhat the same manner as the piston retractor 57 of the embodiment of FIGS. 1 through 5. The fetch pawl is formed of spring steel or other resilient material and has a plurality of radial arms 158 that extend outwardly and somewhat downwardly to approximately the interior wall of the piston 141 as indicated in FIG. 6.

The fetch pawl 157 is held in place by a snap ring 159 that seats in an annular groove 160 also formed in the valve head 155. The fetch pawl is of such a shape and resiliency that it can flex to enable the operating rod assembly 150 to be inserted axially into the interior of the piston and moved past the radial ribs 143 and 144 into the operating position illustrated in FIG. 6.

The fetch pawl 157 does not function during the normal operating cycle, however, it is operable during starting and after misfire to engage the upper portion of the radial rib 143 so that when the engine is cranked, the rod assembly will engage and move the piston as the connecting rod pulls the rod assembly downward in response to rotation of the crankshaft.

As indicated above, this unique engine design eliminates the need for crank case induction and thus the need for premixed or injected oil.

Also the engine of the invention eliminates the need for complex inlet valving (e.g. reed or rotary valves) as required by prior art two-stroke engines.

Equally significant is the advantage that no wrist pin is required in the piston as is conventionally the case where the connecting rod is pivotally connected to the piston itself. On the contrary, in the present design, the piston "floats" in the cylinder and is forced into engagement with the operating rod in response to pressure conditions in the cylinder during the operating cycle.

It will also be noted that because the need for a wrist pin is eliminated the piston wall may be relatively thin to minimize weight and thus the inertia of the piston assembly. As a result, the piston may be formed of steel which has a coefficient of thermal expansion approximately the same as that of the cast iron cylinder. By using a steel piston the need for seal rings can also be eliminated.

Although a ringless piston is described, this unique two-stroke concept can also be designed to incorporate a ringed piston wherein design requirements and operating conditions specify a superior compression seal. This modification would, of course, require attendant modification to the cylinder lining.

While the invention has been shown and described with respect to a specific embodiment thereof, this is for the purpose of illustration rather than limitation and other variations and modifications of the specific embodiment herein shown and described will be apparent to those skilled in the art, all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In a two-stroke cycle internal combustion engine having a crankshaft, at least one connecting rod pivotally connected at one end to the crankshaft and a gas charge induction means, the improvement which comprises:

a cylinder having a head end and a rearward end closure, a passage in said closure, a reciprocating piston positioned in said cylinder and defining therewith a combustion chamber and a charging chamber as the piston moves between its top dead center position and its bottom dead center position, inlet means normally closed by said piston and being open to said charging chamber when said piston moves to its top dead center position for controlling delivery of a gas charge to said combustion chamber, exhaust means normally closed by said piston and being open to said combustion chamber when said piston moves to its bottom dead center position for controlling discharge of gas combustion products from said combustion chamber, means formed in the crown of said piston defining a valve port adapted to establish controlled communication between said charging chamber and said combustion chamber, and, an operating rod connected to said piston in said cylinder and extending through said passage, said operating rod being connected at its outer end to said connecting rod and having a valve head formed on its inner end to close said valve port, said piston and operating rod being in valveclosing engagement during the operating cycle of the engine, except for a portion of each operating cycle when the piston passes through its bottom dead center position wherein retraction movement is limited by fluid pressure caused by compressed gas in said charging chamber, said operating rod being further retracted by said crankshaft and said connecting rod to open said valve port to admit a gas charge from said charging chamber to said combustion chamber.

2. A two-stroke cycle engine as defined in claim 1 wherein said means formed in said crown defines an axial valve port that forms a rearwardly facing valve seat engageable with said valve head.

3. A two-stroke cycle engine as defined in claim 1 wherein said inlet means comprises a plurality of radial inlet ports formed in the wall of said cylinder.

4. A two-stroke cycle engine as defined in claim 1 wherein said exhaust means comprises a plurality of radial exhaust ports formed in the wall of said cylinder.

5. A two-stroke cycle engine as defined in claim 1 wherein said cylinder is formed of a metal that provides a high lubricity at operating temperatures.

6. A two-stroke cycle engine as defined in claim 5 wherein said cylinder is formed of a ferrous material.

7. A two-stroke cycle engine as defined in claim 6 wherein said material is a grey iron.

8. A two-stroke cycle engine as defined in claim 7 wherein said material is a grey iron with a type A pearlite and graphite matrix.

9. A two-stroke cycle engine as defined in any of claims 1, 5, 6, 7 or 8 wherein said piston is formed of a metal with a coefficient of thermal expansion that harmonizes with the coefficient of thermal expansion of the cylinder metal.

10. A two-stroke cycle engine as defined in any of claims 1, 5, 6, 7 or 8 wherein said piston is formed of steel.

11. A two-stroke cycle engine as defined in claim 1 wherein said cycle engine comprises at least two of said cylinders with their respective operating rod means operatively connected to said crankshaft.

12. A two-stroke cycle engine as defined in claim 11 wherein said cylinders are arranged in an in-line configuration.

13. A two-stroke cycle engine as defined in claim 11 wherein said cylinders are arranged in an angular configuration relative to a plane perpendicular to the axis of the crankshaft.

14. A two-stroke cycle engine as defined in claim 11 wherein said cylinders are arranged in a radial configuration.

15. A two-stroke cycle engine as defined in claim 1 wherein said fuel induction means comprises at least one fuel injector.

16. In a two-stroke cycle internal combustion engine having a crankshaft, at least one connecting rod pivotally connected at one end to the crankshaft, fuel induction means and ignition means, the improvement which comprises:

a cylinder having a head end and a rearward end closure, a sealed passage in said closure, a reciprocating piston in said cylinder and defining therewith a combustion chamber and a charging chamber as the piston moves between its top dead center position and its bottom dead center position, a plurality of radial inlet ports formed in the cylinder so as to be normally closed by said piston and being open to said charging chamber when said piston is in its top dead center position, a plurality of radial exhaust ports formed in the cylinder so as to be normally closed by said piston and being open to said combustion chamber when said piston is in its bottom dead center position, means formed in said piston defining an axial valve port between said charging chamber and said combustion chamber and forming a valve seat and, an operating rod axially mounted in said cylinder and extending through said sealed axial passage in said rearward end closure of said cylinder, said operating rod being pivotally connected at its outer end to said connecting rod and having a valve head formed on its inner end to sealingly engage said valve seat and close said valve port, said piston and operating rod being forced by fluid pressure into valve-closing engagement during the operating cycles of the engine, except for a portion of each operating cycle when the piston passes through its bottom dead center position wherein retraction movement is limited by fluid pressure caused by compressed gas in said charging chamber, and said operating rod is further retracted by said crankshaft and said connecting rod to open said valve port to admit a charge from said charging chamber to said combustion chamber.

17. A two-stroke cycle engine as defined in claim 16 wherein said fuel induction means comprises at least one fuel injector mounted in the head end of said cylinder and communicating with said combustion chamber.

18. A two-stroke cycle engine as defined in claim 16 wherein said ignition means comprises at least one spark plug mounted in the head end of said cylinder.

19. A two-stroke cycle engine as defined in claim 16 further including piston retractor means slidably received on said operating rod for axial movement thereon and adapted for operative engagement with said piston as necessary during starting and after misfire.

20. A two-stroke cycle engine as defined in claim 16 further including piston retractor means comprising an annular element secured to said operating rod and extending radially outward therefrom and a projection formed in the interior wall of said piston and adapted to be operatively engaged by said annular element to retract said piston in response to movement of said operating rod.

21. A two-stroke cycle internal combustion engine having a crankshaft, a cylinder with a cylinder head, a piston in said cylinder, a driving connection including a piston rod between said piston and said crankshaft whereby rotary crankshaft motion is developed by reciprocating motion of said piston;

said piston and said cylinder defining a combustion chamber of variable volume between said piston and said cylinder head, a radial flow exhaust gas port in said cylinder at a first location, a radial flow inlet gas charge port in said cylinder at a second location;

said piston being positioned in said cylinder and adapted to cover said exhaust port and to uncover said inlet port when said piston approaches its top dead center position;

said piston being adapted to cover said inlet port and to uncover said exhaust port when said piston approaches its bottom dead center position;

and charge valve means in said piston responsive to movement of said piston rod when said piston uncovers said exhaust ports for discharging a gas charge into said combustion chamber.

22. The combination as set forth in claim 21 wherein said driving connection comprises connecting members defining lost motion between said piston rod and said piston whereby said piston floats relative to said piston rod and is adapted to move relative to said piston rod and is adapted to move relative to said piston rod upon a change in the direction of the differential pressure forces acting on said piston whereby said charge valve means is opened.

23. The combination as set forth in claim 22 wherein said charge valve means comprises a valve port in said piston and a valve element connected to said piston rod and registering with said valve port whereby said relative movement causes said gas charge discharge.

24. The combination as set forth in claim 21 wherein said piston has formed therein a valve port, said piston rod having one end thereof defining a valve element that registers with said valve port;

said piston rod and said piston being in valve-closing engagement during the operating cycle of the engine, except for a portion of the operating cycle when the piston passes through its bottom dead center position, retraction movement of said piston away from said cylinder head being limited by gas charge pressure acting on said piston opposing combustion pressure in said combustion chamber, said piston rod and said piston being in valve-opening position upon further retraction of said piston rod.

25. A two-stroke cycle internal combustion engine having a crankshaft and a cylinder;

a double acting piston in said cylinder, a cylinder head at one end of said cylinder, said piston and said cylinder head forming with said cylinder a fuel combustion chamber on one side of said piston;

a gas charge chamber defined in part by said piston and said cylinder on the opposite side of said piston;

a radial flow exhaust port in said cylinder;

a radial flow gas charge port in said cylinder spaced axially from said exhaust port;

said piston covering said exhaust port during expansion of said combustion chamber upon movement of said piston away from said cylinder head and uncovering said exhaust port when said piston approaches its bottom dead center position;

said piston covering said charge port during expansion of said charge chamber upon movement of said piston toward said cylinder head and opening said charge port when said piston approaches its top dead center position;

means for connecting said piston to said crankshaft including a piston rod and a lost motion connection between said piston rod and said piston;

a charge valve port in said piston between said combustion chamber and said charge chamber, said piston rod and said piston having registering valve portions adapted to control the opening and closing of said charge valve port in response to changes in the pressure differential acting on said piston.

26. The combination as set forth in claim 25 wherein said charge chamber is defined in part by an end wall at the other end of said cylinder, a sealed rod opening in said end wall, said piston rod extending through said rod opening.

27. The combination as set forth in claim 25 wherein said gas charge port is adapted to communicate with an air supply, said engine including means in said cylinder head for injecting fuel into said combustion chamber during compression of said combustion chamber as said piston moves towards its top dead center position.

* * * * *